US010513868B1

(12) United States Patent
Timothy et al.

(10) Patent No.: US 10,513,868 B1
(45) Date of Patent: Dec. 24, 2019

(54) ROLL GATE TRACK GUIDE

(71) Applicants: Erik Timothy, Apollo Beach, FL (US); Orlando Tellez, Sarasota, FL (US)

(72) Inventors: Erik Timothy, Apollo Beach, FL (US); Orlando Tellez, Sarasota, FL (US)

(73) Assignee: Nationwide Industries Inc., Tampa, FL (US)

( * ) Notice: Subject to any disclaimer, the term of this patent is extended or adjusted under 35 U.S.C. 154(b) by 165 days.

(21) Appl. No.: 15/731,611

(22) Filed: Jul. 10, 2017

Related U.S. Application Data

(60) Provisional application No. 62/493,639, filed on Jul. 11, 2016.

(51) Int. Cl.
*E04H 17/06* (2006.01)

(52) U.S. Cl.
CPC ..... *E04H 17/06* (2013.01)

(58) Field of Classification Search
CPC ..... E04H 17/00; E04H 17/02; E04H 17/06
USPC ..... 256/73
See application file for complete search history.

(56) References Cited

U.S. PATENT DOCUMENTS 100,620 A * 3/1870 Hart ..... E06B 11/045
2,320,991 A * 6/1943 White ..... B61D 47/00 193/1
4,261,557 A * 4/1981 Johnson ..... E04H 17/00 105/150
4,791,757 A * 12/1988 Orlando ..... E06B 11/045 49/360
5,476,133 A * 12/1995 Torkelson ..... E04H 17/06 160/328
6,006,479 A * 12/1999 Fayle ..... E04H 12/2292 52/244
6,705,598 B2 * 3/2004 Collins ..... E04H 17/08 256/35

* cited by examiner

*Primary Examiner* — Michael P Ferguson
(74) *Attorney, Agent, or Firm* — Arthur W. Fisher, III

(57) ABSTRACT

A protective guard mounted to a substantially horizontal fence rail of a chain-link fence to protect the chain-link mesh of a roll chain-link gate movable between a first position and a second position to open the portal formed in a chain-link fence when in the first position and to close the portal formed in the chain-link fence when in the second position comprising a substantially flat center base plate having a protective plate formed on the leading or proximal end portion thereof to engage the chain-link mesh as the roll chain-link gate is opened, an alignment plate formed on the trailing or distal end portion thereof to engage the substantially horizontal fence rail to maintain the protective guard in operative alignment relative thereto and an attachment member to secure the protective guard to the substantially horizontal fence rail.

6 Claims, 10 Drawing Sheets

ROLL GATE TRACK GUIDE

CROSS REFERENCE

This is a utility application of provisional application Ser. No. 62/493,639, filed Jul. 11, 2016.

BACKGROUND OF THE INVENTION

Field of the Invention

A protective guard to protect the chain-link mesh of a roll chain-link gate from engaging a substantially horizontal fence rail adjacent a portal formed in a chain-link fence as the roll chain-link gate is opened.

Description of the Prior Art

There are many types of fences for a multitude of uses. The various types are generally classified by functions that include:

- Agricultural fencing to keep livestock in and/or predators out.
- Acoustic fencing to reduce noise pollution.
- Privacy fencing to provide privacy and security.
- Temporary fencing to provide safety, security, and to direct movement; wherever temporary access control is required, especially on building and construction sites.
- Perimeter fencing to prevent trespassing or theft and/or to keep children and pets from wandering away.
- Decorative fencing to enhance the appearance of a property, garden or other landscaping.
- Boundary fencing to demarcate a piece of real property.
- Pest-exclusion fence.
- Pet fence underground fence for pet containment.
- Pool fence.
- Snow fence.

The construction of fences for these various uses or functions ranges from:

- Brushwood fencing a fence made using wires on either side of brushwood, to compact the brushwood material together.
- Chain-link fencing made of wires woven together.
- Close boarded fencing Strong and robust fence constructed from morticed posts, arris rails and vertical feather edge boards.
- Concrete fence easy to install and highly durable.
- Ha-ha or sunken fence.
- Hurdle fencing made from moveable sections.
- Palisade or Stakewall.
- Picket fences generally a waist-high, painted, partially decorative fence.
- Post-and-rail fencing.
- Roundpole fences similar to post-and-rail fencing but more closely spaced rails.
- Slate fencing in Mid-Wales.
- Slate fence, a type of palisade made of vertical slabs of slate wired together.
- Spear-top fence.
- Split-rail fences made of timber.
- Stockade fence a waist-high or higher solid fence composed of contiguous or very closely spaced round logs, posts, stakes, or half-round boards pointed at the top.
- Vinyl fencing.
- Wattle fencing of split branches woven between stakes.
- Wood-panel fencing.
- Wrought iron fencing made from tube steel.

- Wall fences including Dry-stone wall or rock fence.
- Wire fences including:
  - smooth wire fence,
  - barbed wire fence,
  - electric fence,
  - w wire fencing many designs, from fine chicken wire to heavy mesh "sheep fence" or "ring fence", and
  - welded wire mesh fence.

The present invention relates specifically to a protective guard for a rolling gate for a chain-link fence also referred to as wire netting, wire-mesh fence, chain-wire fence, cyclone fence, hurricane fence, or diamond-mesh fence is a type of woven fence usually made from galvanized or LLDPE-coated steel wire. The wires run vertically and are bent into a zig-zag pattern so that each "zig" hooks with the wire immediately on one side and each "zag" with the wire immediately on the other. This forms the characteristic diamond pattern or mesh.

While some of the prior art may contain some similarities relating to the present invention, none of them teach, suggested or include all of the advantages and unique features of the invention disclosed hereafter.

SUMMARY OF THE INVENTION

The present invention relates to a protective guard mounted to a substantially horizontal fence rail of a chain-link fence to protect the chain-link mesh of a roll chain-link gate as the roll chain-link gate is rolled open and closed.

The protective guard is mounted on the proximal end of a fence rail attached to a chain-link fence post disposed on one side of the portal formed in the chain-link fence to sliding engage the chain-link mesh of the roll chain-link gate as the roll chain-link gate is rolled open and closed.

The protective guard comprises a center base plate having a protective plate on the proximal or leading end of the center plate, an alignment plate formed on the distal or trailing end of the center base plate including an alignment aperture to receive the fence rail therethrough to maintain the protective guard in alignment relative to the chain-link mesh of the chain-link gate and an attachment member including an aperture to receive a fastener therethrough to secure the protective guard to the proximal end of the fence rail.

When properly mounted or installed the protective guard 10 is substantially vertically disposed.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

The present invention relates to a protective guard generally indicated as 10 mounted to a substantially horizontal fence rail 12 of a chain-link fence generally indicated as 14 to protect the chain-link mesh generally indicated as 16 affixed between an substantially horizontal upper gate rail (not shown) and a substantially horizontal lower gate rail 18 of a roll chain-link gate generally indicated as 20 is rolled open and closed.

Figure 1:
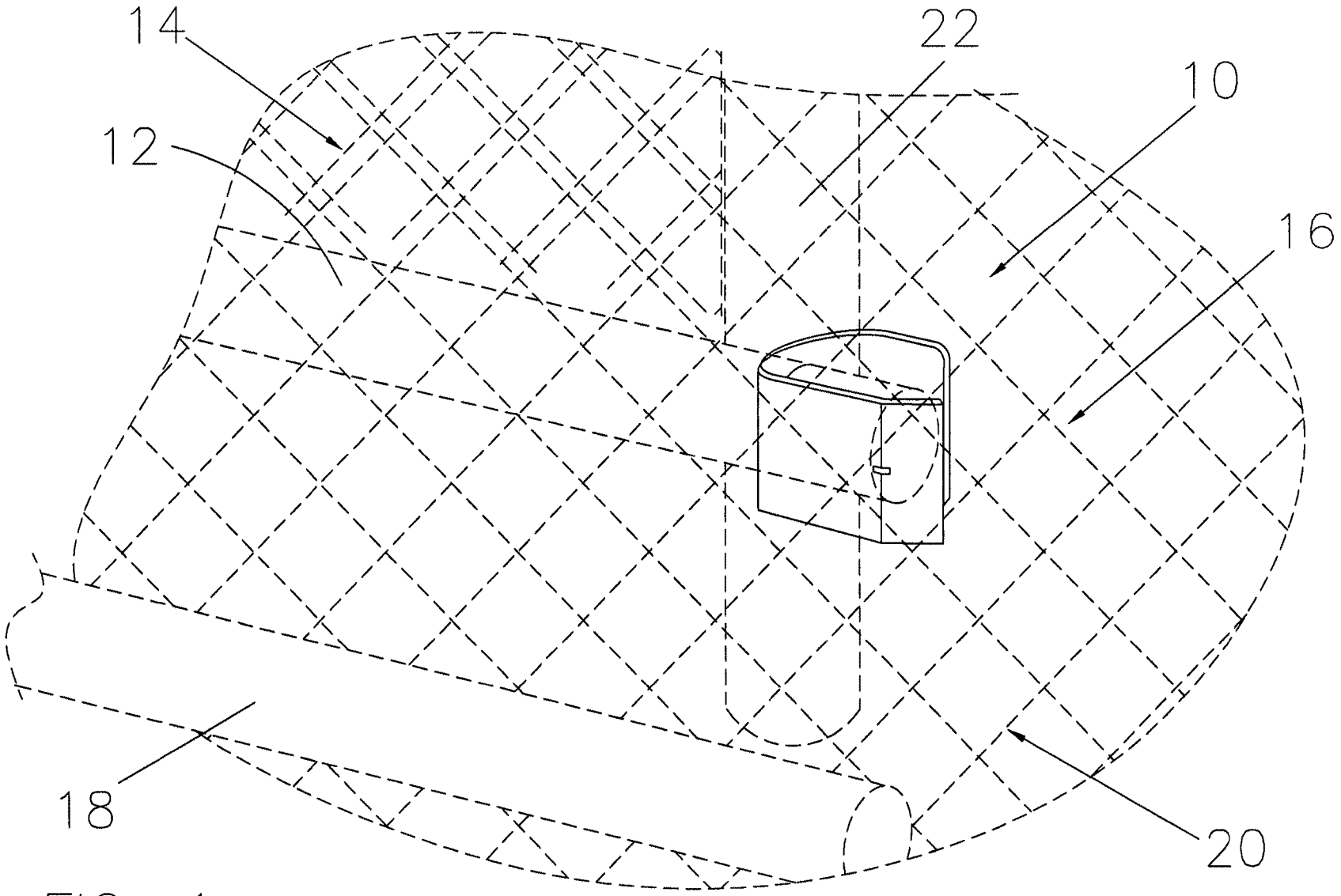
FIG. 1 is a perspective view of the protective guard of the present invention.
Figure 2:
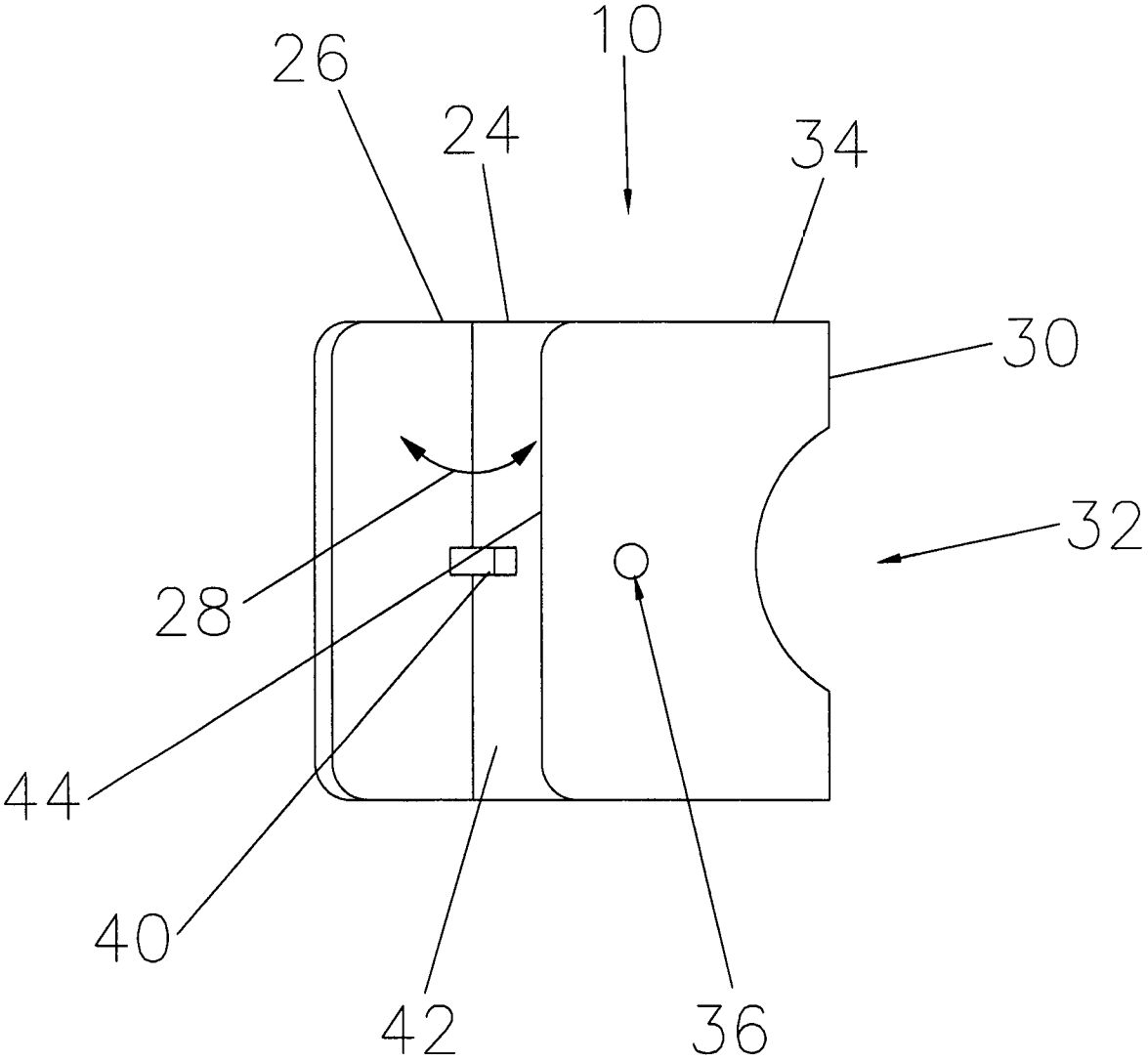
FIG. 2 is a side view of the protective guard of the present invention.
Figure 3:
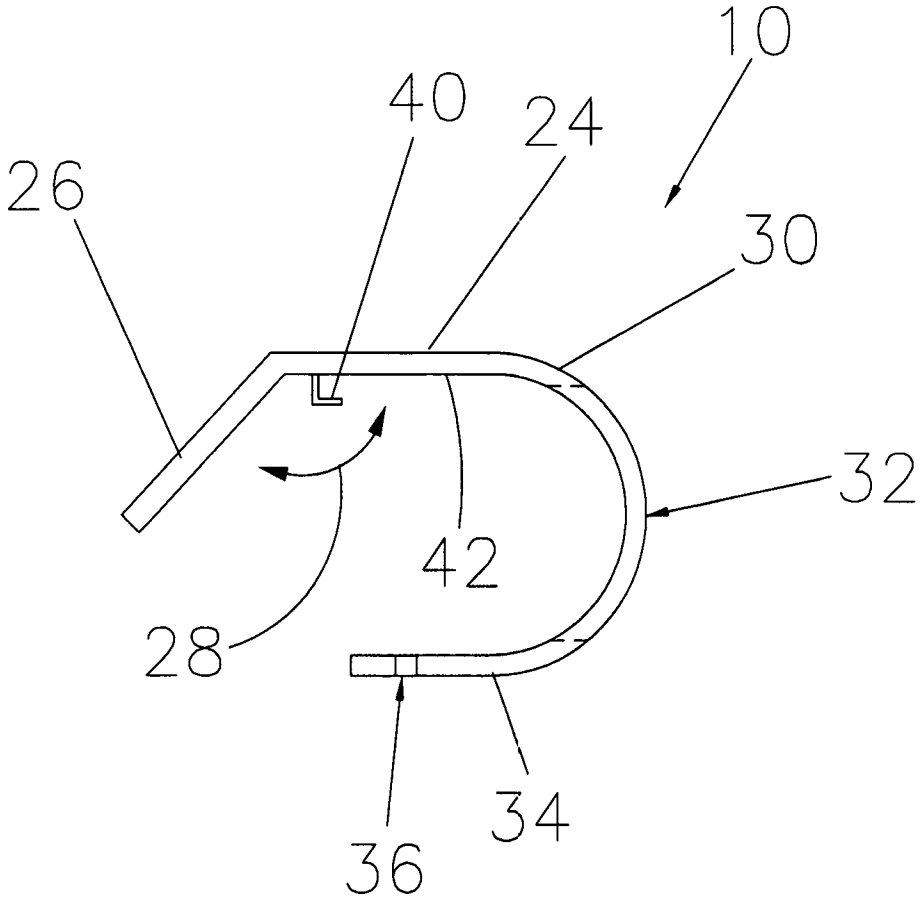
FIG. 3 is a top view of the protective guard of the present invention.
Figure 5:
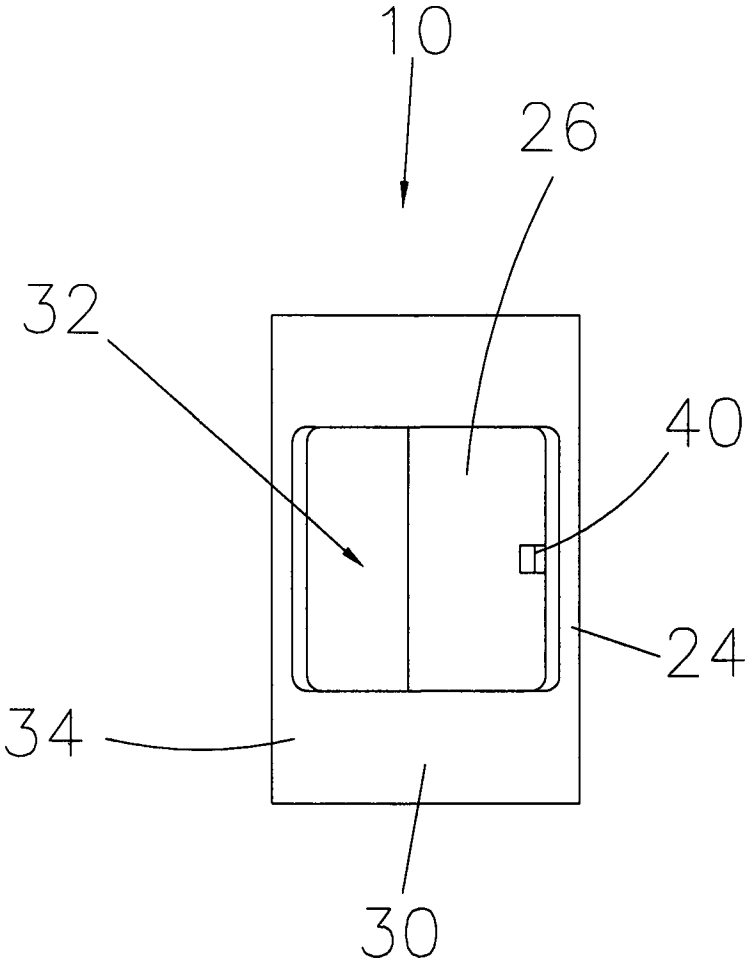
FIG. 5 is a distal end view of the protective guard of the present invention.
Figure 4:
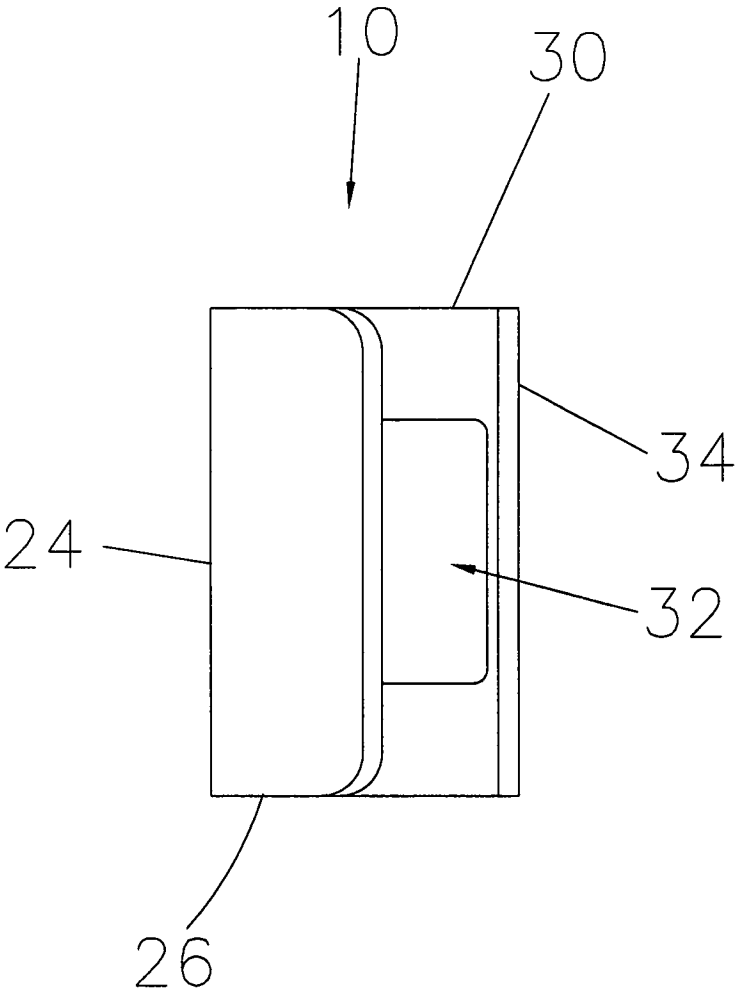
FIG. 4 is a proximal end view of the protective guard of the present invention.
Figure 6:
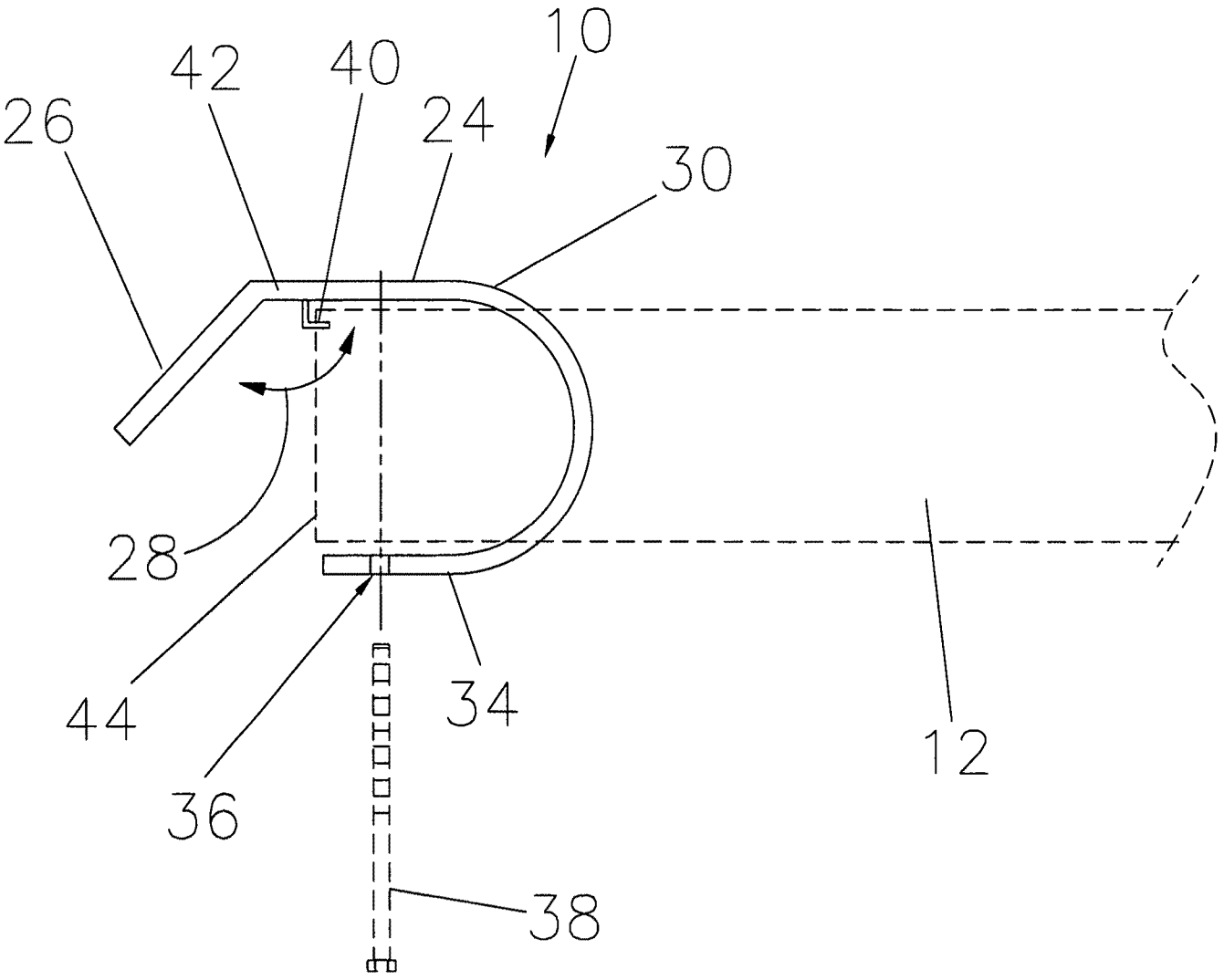
FIG. 6 is a top view of the protective guard of the present invention installed on a substantially horizontal fence rail.
Figure 7:
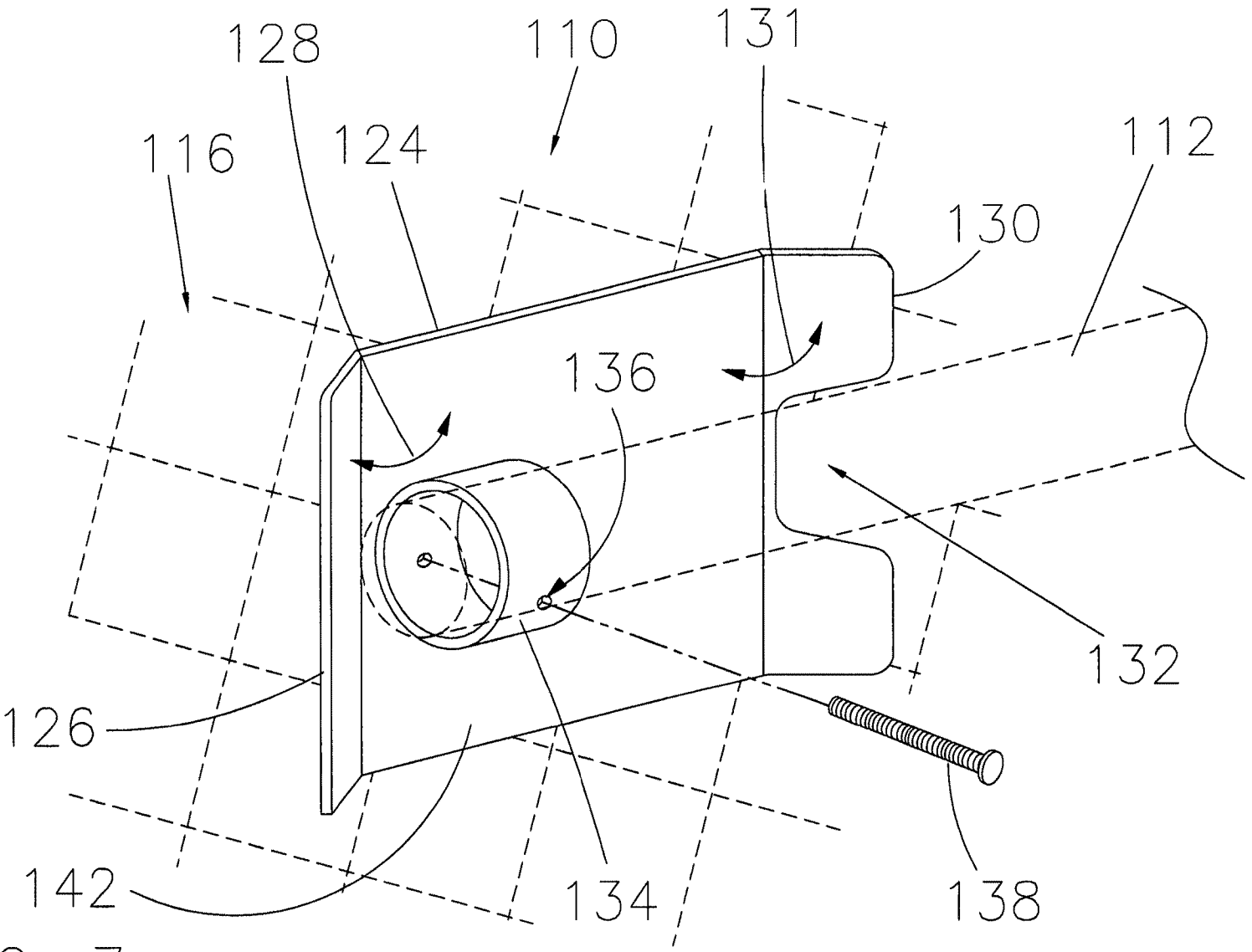
FIG. 7 is a perspective view of another embodiment of the protective guard of the present invention.
Figure 8:
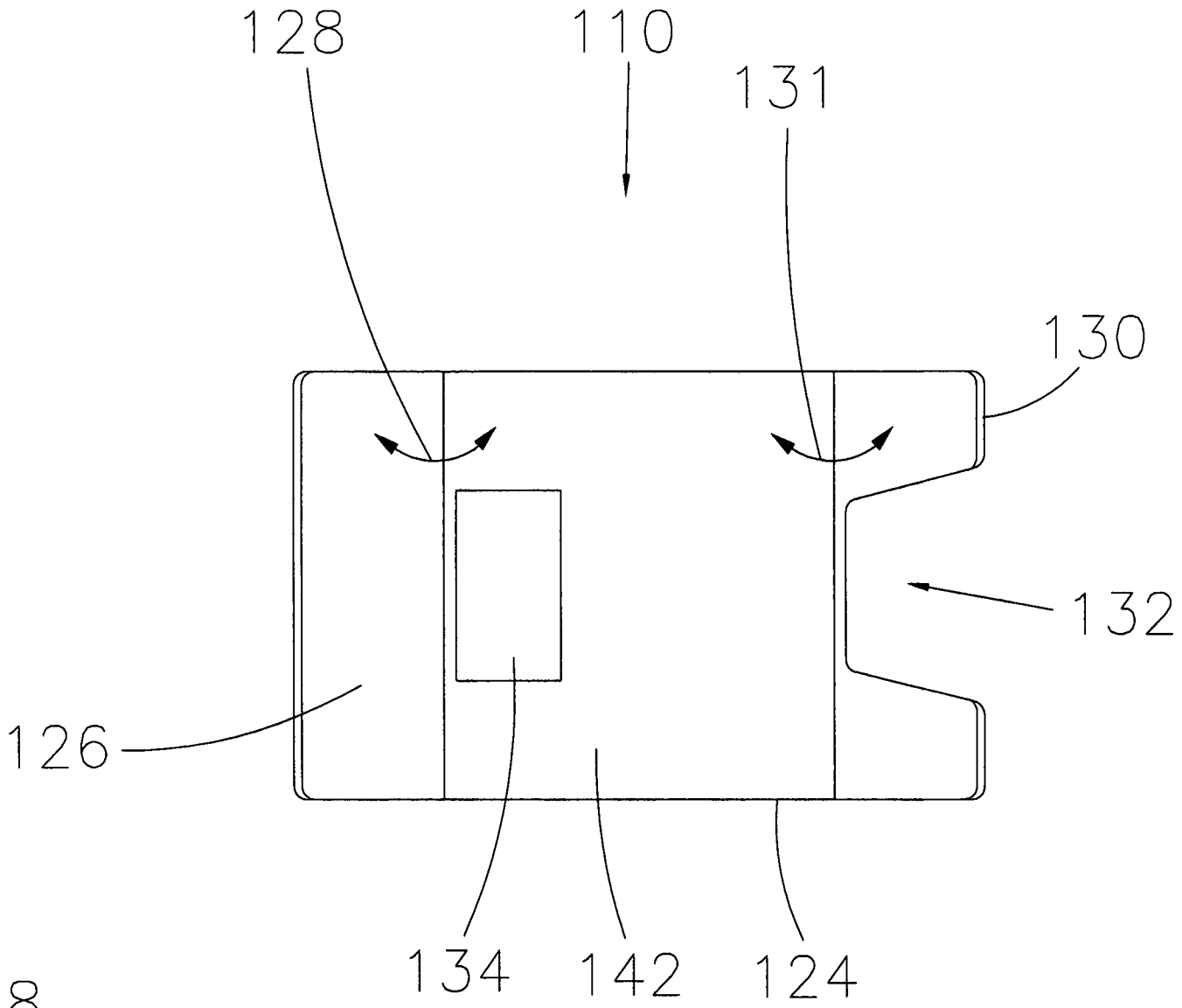
FIG. 8 is a side view of an alternate embodiment of the protective guard of the present invention.
Figure 9:
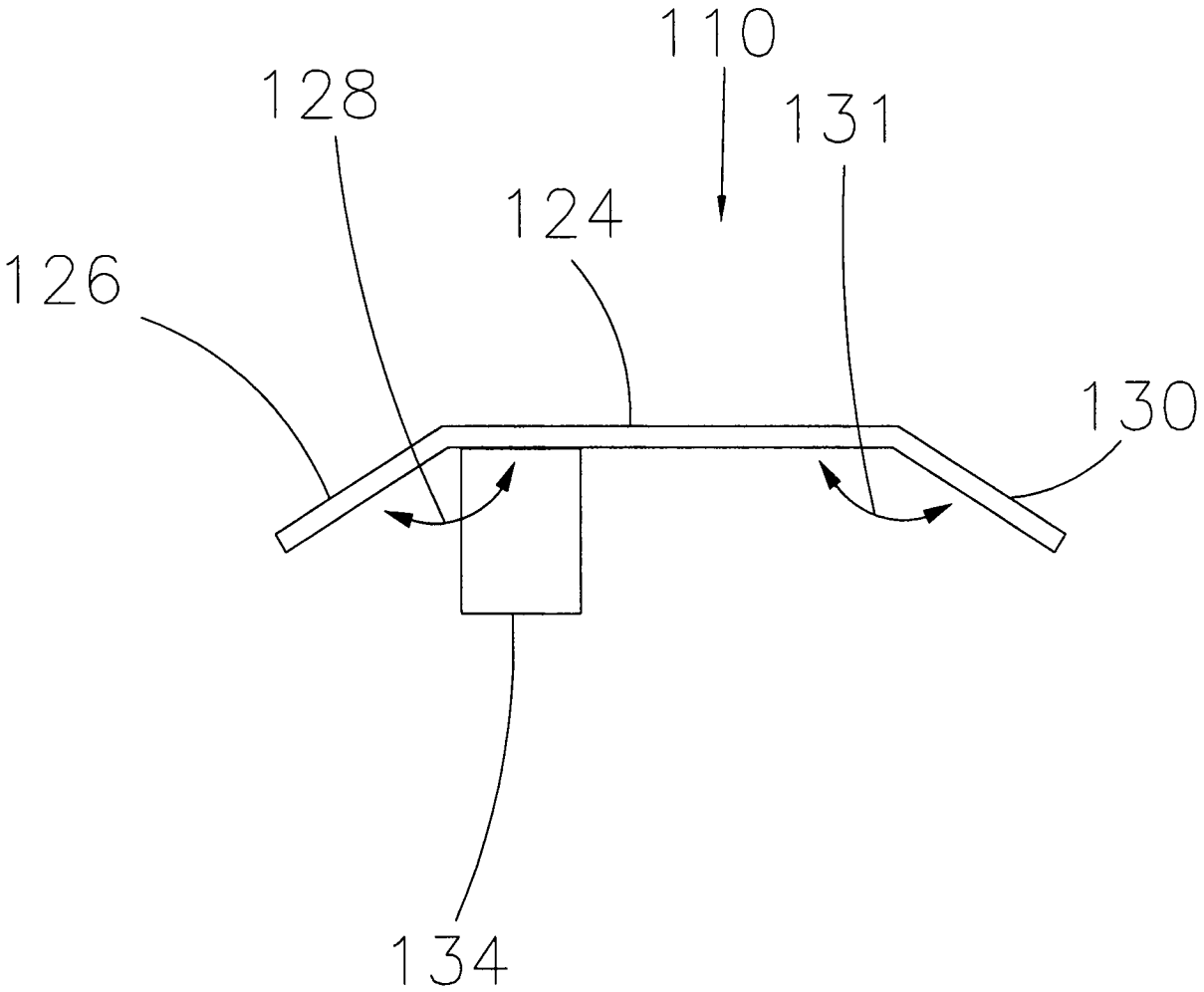
FIG. 9 is a top view of the alternate embodiment of the protective guard of the present invention.
Figure 11:
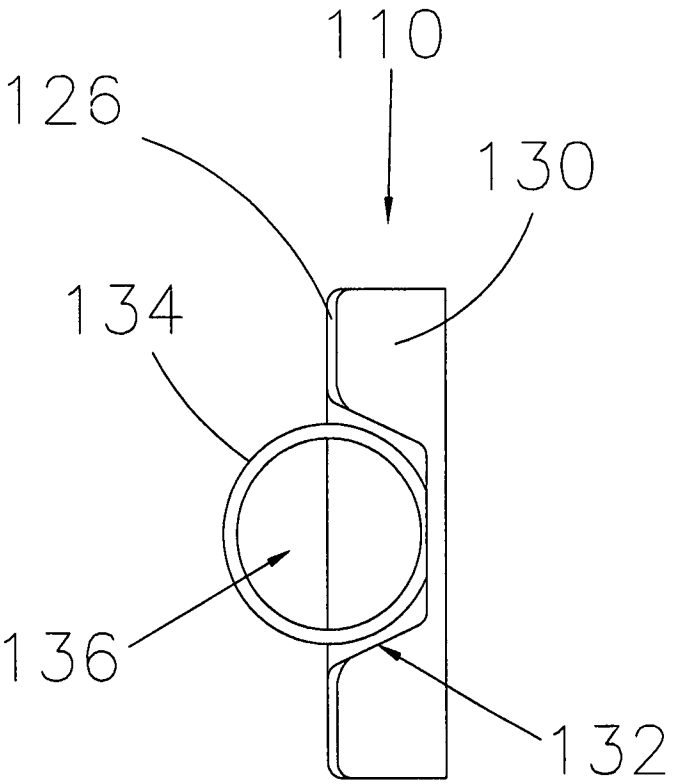
FIG. 11 is a distal end view of the alternate embodiment of the protective guard of the present invention.
Figure 10:
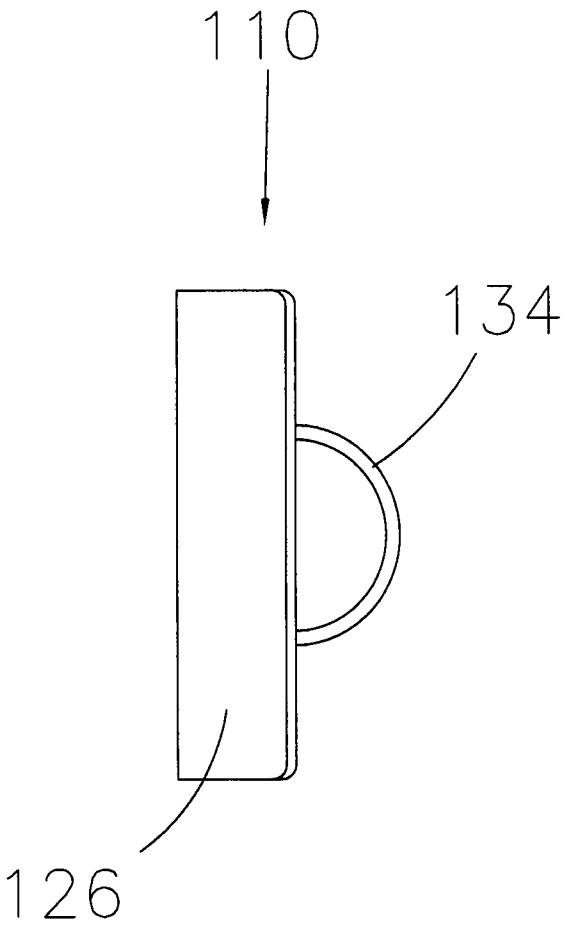
FIG. 10 is a proximal end view of the alternate embodiment of the protective guard of the present invention.
Figure 12:
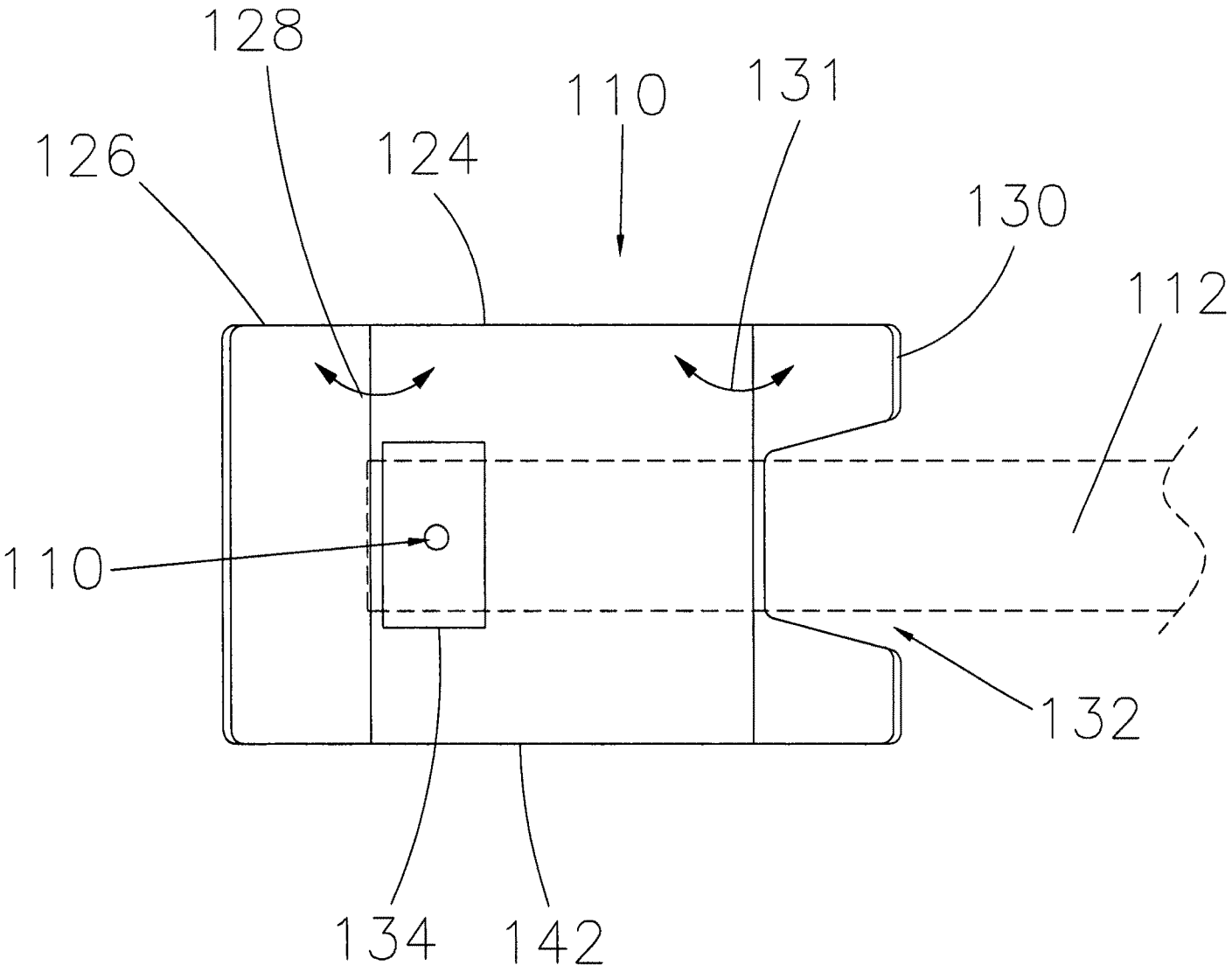
FIG. 12 is a side view of the alternate embodiment of the protective guard of the present invention installed on a substantially horizontal fence rail.

As shown in FIG. 1, the protective guard 10 is mounted on the proximal end of the substantially horizontal fence rail 12 attached to a substantially vertical chain-link fence post 22 disposed on one side of the portal formed in the chain-link fence 14 to sliding engage the chain-link mesh 16 of the roll chain-link gate 20 as the roll chain-link gate 20 is rolled open and closed.

As shown in FIGS. 2 through 6, the protective guard 10 comprises a substantially flat center base plate 24 having a substantially flat protective plate 26 on the proximal or leading end of the substantially flat center plate 24 forming an interior obtuse angle 28 therebetween, an arcuate alignment plate 30 formed on the distal or trailing end of the substantially flat center base plate 24 including an alignment aperture or hole 32 to receive the substantially horizontal fence rail 12 therethrough to maintain the protective guard 10 in alignment relative to the chain-link mesh 16 of the chain-link gate 20 and a substantially flat attachment member 34 extending forward from the arcuate alignment plate 30 including an aperture 36 to receive a fastener such as a screw 38 therethrough to secure the protective guard 10 to the proximal end 44 of the substantially horizontal fence rail 12 disposed in substantially parallel relationship relative to the substantially flat center base plate 24.

A substantially L-shaped or U-shaped stop member 40 extends inwardly from the inner surface 42 of the substantially flat center base plate 24 adjacent the obtuse angle 28 to engage the proximal end 44 of the substantially horizontal fence rail 12.

When properly mounted or installed the protective guard 10 is substantially vertically disposed.

FIGS. 7 through 12 depict an alternate embodiment of the present invention. Specifically, the protective guard 110 on the proximal end of the substantially horizontal fence rail 112 attached to a substantially vertical chain-link fence post (not shown) disposed on one side of the portal formed in the chain-link fence (not shown) to sliding engage the chain-link mesh 116 of the roll chain-link gate (not shown) as the roll chain-link gate is rolled open and closed The protective guard 110 comprises a substantially flat center base plate 124 having a substantially flat protective plate 126 on the proximal or leading end of the substantially flat center plate 24 forming an interior obtuse angle 128 therebetween, a substantially flat alignment plate 130 formed on the distal or trailing end of the substantially flat center base plate 124 forming an interior obtuse angle 131 therebetween including an alignment aperture or slot 132 to receive the substantially horizontal fence rail 112 therethrough to maintain the protective guard 110 in alignment relative to the chain-link mesh 116 of the chain-link gate (not shown) and a substantially circular attachment collar or member 134 extending inwardly from the inner surface 142 of the substantially flat center base plate 124 including an aperture 136 to receive a fastener such as a screw 138 therethrough to secure the protective guard 10 to the proximal end plate of the substantially horizontal fence rail 112.

When properly mounted or installed the protective guard 10 is substantially vertically disposed.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

What is claimed is:

1. A protective guard mounted to a substantially horizontal fence rail of a chain-link fence to protect the chain-link mesh of a roll chain-link gate movable between a first position and a second position to open the portal formed in a chain-link fence when in the first position and to close the portal formed in the chain-link fence when in the second position, said protective guard comprising:

a base plate including an inner surface having a protective plate formed on a leading or proximal end portion thereof to engage the chain-link mesh as the roll chain-link gate is opened;

an alignment plate formed on a trailing or distal end portion of said base plate including an alignment aperture formed therethrough to receive the substantially horizontal fence rail therethrough to maintain said protective guard in operative alignment relative to the substantially horizontal fence rail;

an attachment member extending forward from said alignment plate disposed in spaced substantially parallel relationship relative to said base plate and including a fastener hole formed therethrough to receive a fastener therethrough to secure said protective guard to the substantially horizontal fence rail; and a stop member extending inwardly from the inner surface of said base plate adjacent said protective plate to engage the proximal end of the substantially horizontal fence rail.

2. The protective guard of claim 1 wherein said alignment aperture is axially aligned with said stop member.

3. The protective guard of claim 1 wherein said protective plate forms an interior obtuse angle with said base plate.

4. The protective guard of claim 3 wherein said alignment plate comprises an arcuate configuration.

5. The protective guard of claim 1 wherein said alignment plate comprises an arcuate configuration.

6. A protective guard mounted to a substantially horizontal fence rail of a chain-link fence to protect the chain-link mesh of a roll chain-link gate movable between a first position and a second position to open the portal formed in a chain-link fence when in the first position and to close the portal formed in the chain-link fence when in the second position, the protective guard comprising:

a substantially flat center base plate including an inner surface having a substantially flat protective plate formed on a proximal or leading end of said substantially flat center base plate forming an interior obtuse angle therebetween;

an arcuate alignment plate formed on a distal or trailing end of said substantially flat center base plate including an alignment aperture to receive the substantially horizontal fence rail therethrough to maintain the protective guard in alignment relative to the chain-link mesh of the chain-link gate;

a substantially flat attachment member extending forward from said arcuate alignment plate disposed in a substantially parallel relationship relative to said substantially flat center base plate and including an aperture to receive a fastener therethrough to secure the protective guard to the proximal end of the substantially horizontal fence rail; and a substantially L-shaped or U-shaped stop member extending inwardly from the inner surface of said substantially flat center base plate adjacent said obtuse angle to engage the proximal end of the substantially horizontal fence rail.

* * * * *